US008552645B2

(12) United States Patent
Dudik et al.

(10) Patent No.: US 8,552,645 B2
(45) Date of Patent: Oct. 8, 2013

(54) SEAL AND LEG DESIGN FOR CERAMIC INDUCTION LAMP

(75) Inventors: David C. Dudik, South Euclid, OH (US); Brian C. Danison, Munson Township, OH (US); Paul M. Kuester, Shaker Heights, OH (US); Jianwu Li, Solon, OH (US)

(73) Assignee: General Electric Company, Schenectady, NY (US)

( * ) Notice: Subject to any disclaimer, the term of this patent is extended or adjusted under 35 U.S.C. 154(b) by 647 days.

(21) Appl. No.: 12/609,037

(22) Filed: Oct. 30, 2009

(65) Prior Publication Data

US 2011/0043108 A1 Feb. 24, 2011

Related U.S. Application Data

(60) Provisional application No. 61/110,364, filed on Oct. 31, 2008.

(51) Int. Cl.
*H01J 61/30* (2006.01)

(52) U.S. Cl.
USPC ..... 313/634; 445/23

(58) Field of Classification Search
USPC ..... 313/23, 26, 43, 634, 623–625; 445/23
See application file for complete search history.

(56) References Cited

U.S. PATENT DOCUMENTS

| | | | | |
|---|---|---|---|---|
| 5,095,249 | A * | 3/1992 | Roberts et al. | 315/248 |
| 5,637,963 | A * | 6/1997 | Inoue et al. | 315/248 |
| 5,859,492 | A * | 1/1999 | Austad et al. | 313/243 |
| 5,866,982 | A * | 2/1999 | Scott et al. | 313/634 |
| 6,020,690 | A * | 2/2000 | Takeda et al. | 315/248 |
| 2002/0033670 | A1 * | 3/2002 | Niimi | 313/623 |
| 2003/0178943 | A1 * | 9/2003 | Espiau et al. | 315/39 |
| 2006/0138962 | A1 * | 6/2006 | Wei et al. | 313/634 |

FOREIGN PATENT DOCUMENTS

| | | | |
|---|---|---|---|
| JP | 10134768 | A * | 5/1998 |
| WO | WO 2008075273 | A1 * | 6/2008 |
| WO | WO 2008078225 | A1 * | 7/2008 |

* cited by examiner

*Primary Examiner* — Nimeshkumar Patel
*Assistant Examiner* — Steven Horikoshi
(74) *Attorney, Agent, or Firm* — Fay Sharpe LLP

(57) ABSTRACT

A ceramic arc body includes a main body having a chamber. A leg extends from the main body and has an internal opening therethrough that communicates with the chamber. An electrically non-conductive seal member is received in the leg opening. A tapered internal surface abuttingly engages the seal member and provides for centering of the seal member relative to the leg. A separate tapering region, shoulder, or stop surface limits insertion of the seal member into the leg opening for precision location of the seal member, and in another embodiment, a single continuous taper inside the leg cooperates with a tapered seal member for both centering and precision insertion of the seal member into the leg. In another embodiment, a hybrid electrode is employed where one portion of the hybrid electrode is electrically non-conductive and a second portion of the electrode is electrically conductive. The hybrid electrode mechanically supports both the lamp and the starting coil and also provides electrical connection to the starting coil.

14 Claims, 5 Drawing Sheets

SEAL AND LEG DESIGN FOR CERAMIC INDUCTION LAMP

This application claims priority from U.S. provisional application Ser. No. 61/110,364, filed 31 Oct. 2008, the entire disclosure of which is hereby expressly incorporated herein by reference.

BACKGROUND OF THE DISCLOSURE

The present disclosure relates generally to electrodeless high intensity discharge (HID) lamps. More particularly, this disclosure relates to a ceramic induction HID system and a seal and leg design for hermetically sealing the ceramic induction HID lamp.

An electrodeless or induction high intensity discharge lamp assembly generally includes an arc body located within a central opening of a radio frequency (RF) coil. The coil is typically a multi-turn coil and the arc body is preferably formed of a ceramic whereby the lamp assembly is a substantial improvement over prior quartz arrangements. For example, a ceramic induction HID lamp is believed capable of a lamp life of approximately fifty thousand (50,000) hours. The arc body includes a generally spheroidal portion that in cross-section has the general shape of an ellipse with an elongated, first equatorial axis in one direction and a shorter, second polar axis in a perpendicular direction. At least one ceramic arc body extension or leg extends generally perpendicularly outwardly from the spheroidal portion. Normally the leg is located in a polar region of the spheroidal portion, although there may be other legs located in different regions that communicate with an internal chamber of the spheroidal portion.

The leg is typically hollow and communicates with the internal discharge chamber. It is commonly used as a feedthrough for the ionizing species, and the fill gas of the discharge lamp. In some embodiments of the induction HID lamp, the leg is used for starting purposes and a starting coil is received around the leg. The starting coil is connected to an LC resonant circuit, which provides a start-up or ignition charge to the starting coil. The high voltage coil ionizes the fill and the main RF coil then provides energy to the fill that continues to power the arc discharge, a toroidal-shaped discharge, once ignition of the main fill occurs.

In a traditional HID lamp, an arc tube leg receives an electrically conductive metal electrode. The electrode usually has a crimp or stop surface that locates the electrode in the arc tube leg. Sealing between the metal electrode and the leg is an important consideration and encounters process steps and expensive electrode materials to provide an effective seal design. In addition, the thermal expansion of the metal electrode materials is different from that of the ceramic discharge body, which results in reduced reliability of the seal assembly. The metal electrode is generally a high-temperature refractory metal or cermet material that can handle the electrical feedthrough, high temperatures, and corrosive environment of a metal halide lamp. Commonly, different refractory metals, such as tungsten, molybdenum, and niobium, or cermets of these metals and ceramic materials compatible with the arctube envelope are used. Joining, fabrication, of these materials has many process steps and high cost components.

In the electrodeless or induction HID lamp, there are no electrodes extending into the main discharge chamber. An alternative seal assembly and method to create a robust seal in a ceramic induction lamp are required. A hermetic seal of adequate thickness is required to resist the deleterious impact of the chemical dose or fill. Thus, it is important that the seal member or plug be resistant to chemical attack, and have repeatable construction for ease of assembly. Moreover, the exact location of the seal member within the leg necessarily impacts the volume of the halide dose in the lamp. Again, to enable consistent lamp performance, it is desirable that the dose be closely controlled and likewise this includes provision of a precise, repeatable seal member that is exactly located relative to the leg or arc body.

It would also be preferable if the structure and associated mounting could be simplified. This, in turn, would lead to lower cost in production and materials. Like the remainder of the lamp arc body, it would be preferred if the seal member were made from a non-conductive material, to prevent current flow from inside the arctube to outside, and preferably from the same ceramic used to form the remainder of the arc body. Moreover, a uniform seal thickness between the leg and seal member, and controlled location or insertion length of the seal member within the leg, become important.

Use of a ceramic seal plug is not ideal for all situations. In some instances, a metal is required externally of the body of the discharge lamp to provide electrical connection to the starting coil, for example, and also to mechanically support the electrodeless lamp and mechanically support the starting coil. Thus, an electrode structure with a non-conductive element inside the lamp and conductive element outside the lamp may be preferable.

Accordingly, a need exists for an improved seal and leg design for a ceramic induction lamp.

SUMMARY OF THE DISCLOSURE

A ceramic arc body includes a main body having a chamber. At least one leg extends from the main body and has an internal opening that communicates with the chamber. An electrically non-conductive seal member is received in the leg opening.

Preferably, the non-conductive material of the seal member is a ceramic.

More preferably, the non-conductive material is the same ceramic material as the arc discharge chamber, so that it is chemically and thermally compatible with the chamber.

The leg opening has a tapered internal surface, a portion of which abuttingly engages the seal member.

In another embodiment, a separate tapering region, shoulder, or stop surface limits insertion of the seal member into the leg opening.

A seal glass is interposed between the seal member and the leg, and the tapering region centers the seal member within the leg.

In another embodiment, a hybrid electrode is employed where the interior portion of the hybrid electrode which communicates with the arc discharge chamber is electrically non-conductive and a second portion of the electrode is electrically conductive. The hybrid electrode may mechanically support both the lamp and the starting coil or provide electrical connection to the starting coil.

In another exemplary embodiment, a hybrid electrode mechanically supports the electrodeless lamp and starting coil while simultaneously providing electrical connection to the starting coil.

A primary benefit is the ability to hermetically seal a ceramic induction HID arc body, using a non-conductive electrode element which will not detrimentally affect the performance of the ceramic induction HID lamp, as a conductive member inside the lamp would.

Another benefit is associated with precisely controlling the volume of the leg (and likewise the volume of the main chamber) that is filled with a metal halide dose in a manner and using materials that are simple, low cost, and repeatable.

Another benefit resides in the ability to ensure consistent seal thickness around the seal member.

Yet another benefit is the ability to mechanically support the electrodeless lamp and starting coil while simultaneously providing electrical connection to the starting coil.

Still other benefits and advantages of the present disclosure will be found upon reading and understanding the following detailed description.

DETAILED DESCRIPTION OF THE PREFERRED EMBODIMENTS

Figure 1:
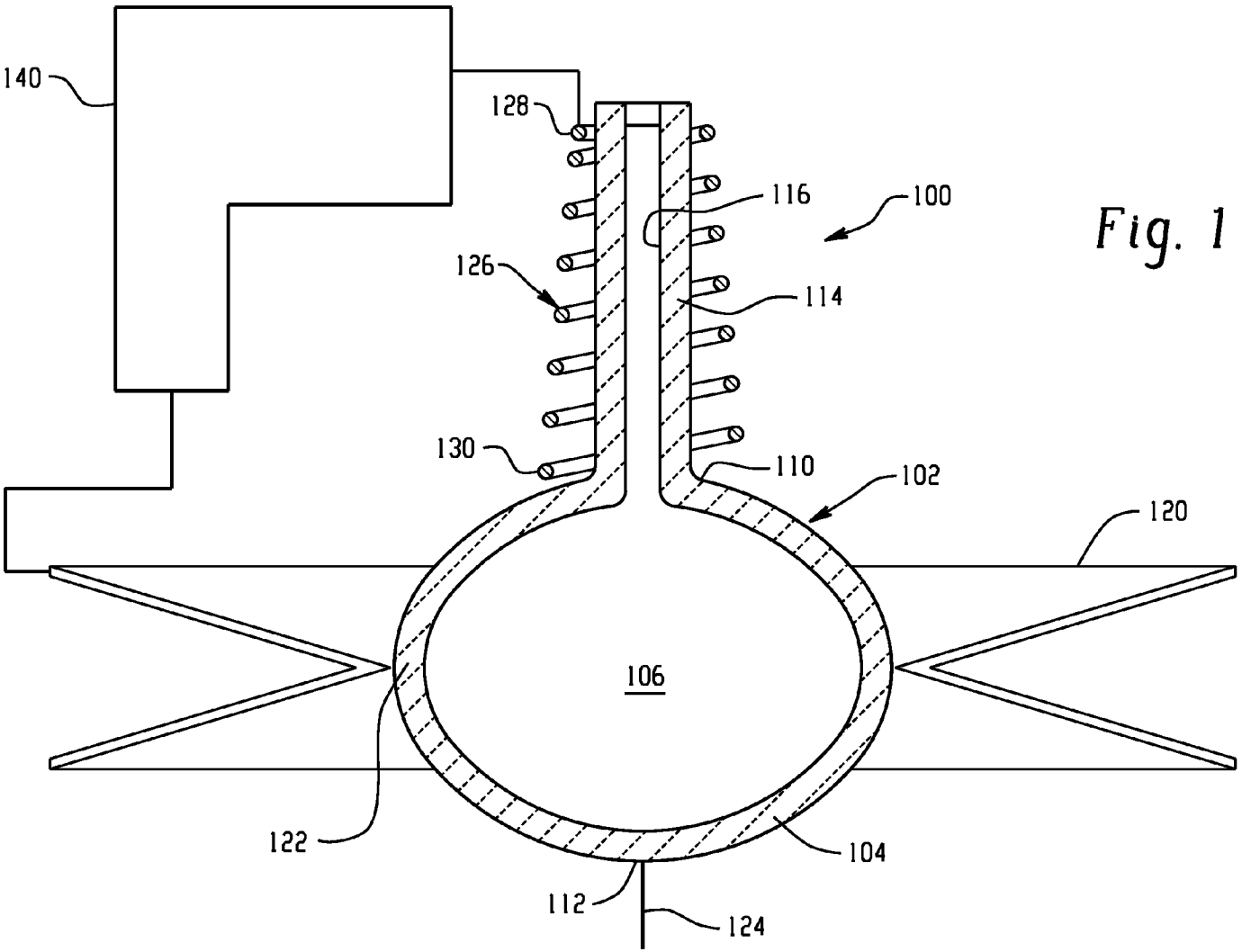
FIG. 1 is an elevational view, partly in section, of an electrodeless or induction HID lamp.

An electrodeless high intensity discharge (HID) or ceramic induction lamp assembly 100 is shown in FIG. 1. The lamp assembly includes a main envelope or arc body 102. Preferably, the arc body has an ellipsoidal or generally spheroidal portion 104 that encloses a similarly shaped, main chamber 106 housing a desired main fill. The main chamber is hermetically sealed from the external or ambient environment after the main fill has been introduced or dosed into the arc body. The arc body is preferably made from a ceramic material that is light transmissive such as polycrystalline alumina, although other materials may be used where conducive to the demands or needs of the electrodeless lamp environment.

The generally spheroidal portion 104 of the arc body has first and second polar regions 110, 112. Extending outwardly from the first polar region 110 is an envelope extension or leg 114. The leg is hollow and defines a cavity or starting chamber 116 that communicates with the main chamber 106. The leg has a substantially smaller cross-sectional dimension than the main chamber of the spheroidal portion. Typically, the leg is used to introduce the dose into the main chamber, and a distal or outer end of the leg spaced from the spheroidal portion of the arc body is subsequently sealed or plugged.

A radio frequency or RF coil 120 serves as the main coil and extends about an equatorial or median region 122 of the arc body. The coil is preferably a multi-turn assembly such as the illustrated coil that includes first and second turns, although a greater number of turns could be used if desired. The coil preferably has a low profile and desirably does not significantly impact or block the light emitted from the main chamber. The main RF coil is closely disposed adjacent a perimeter of the equatorial region 122 of the spheroidal portion of the arc body in order to provide energy to the fill and continue to power the arc discharge, i.e., a toroidal-shaped discharge, once ignition of the main fill occurs.

A high voltage conductor or wire 124 terminates closely adjacent the second polar region 112 of the arc body. In addition, a starting member, starting conductor, or helical starting coil 126 has a first end 128 disposed adjacent the distal end of the leg 114. The helical starting coil proceeds along the length of the leg toward the first polar region 110 of the arc body, where a second end 130 of the starting coil abuts or is closely spaced from the first polar region 110 of the arc body. The first end 128 of the starting coil is connected to an LC resonant circuit 140 which provides a start-up or ignition charge to the starting coil 126. The operation of the circuit is well-known in the art, and the circuit also works in conjunction with the main coil to continue the discharge once the discharge is initiated and the toroidal plasma inside the lamp provides light output.

Figure 2:
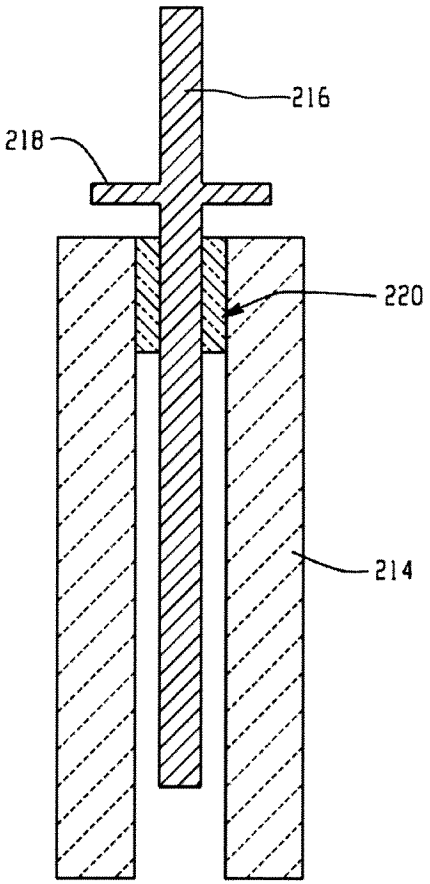
Fig. 2 PRIOR ART
FIG. 2 is a cross-sectional view through a ceramic arc tube leg associated with a conventional HID lamp and employing a metal electrode.

In FIG. 2, leg 214 of a prior art HID lamp is shown enclosing a metal electrode 216 that employs a crimp or cross-member 218 to limit insertion of the metal electrode into the leg. A seal glass 220 fills an annular space between the external surface of the metal electrode and the inner surface of the leg. As is well-known in the art, this assembly is difficult to assemble, and relatively expensive to manufacture, in order to contain the fill within the arc chamber. Also, the metal seal materials required for the electrical feedthrough do not match the thermal expansion of the ceramic material, making seal reliability an issue.

Figure 3:
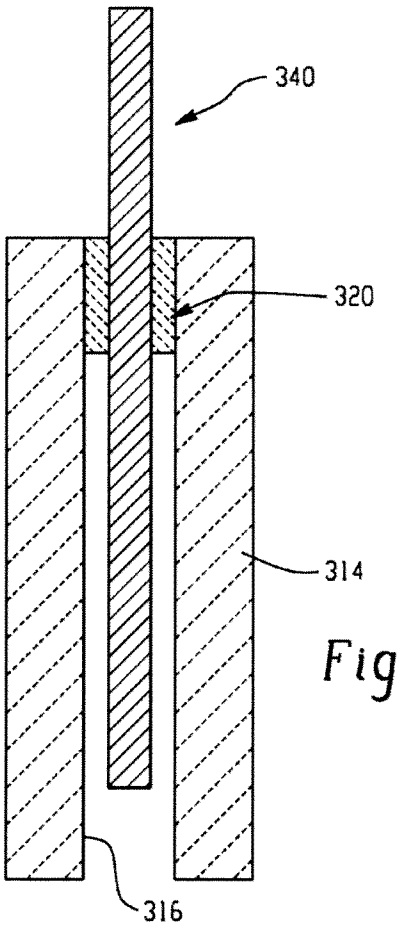
FIG. 3 is a cross-sectional view illustrating use of a non-conductive or ceramic seal member for an electrodeless lamp.

As will be appreciated, there is no metal electrode extending into the main chamber with the induction lamp of the type shown in FIG. 1. Therefore, once the dose has been introduced into the arc body, it is still necessary to seal or plug the leg. Particularly, an electrically non-conductive, preferably ceramic, seal member or plug 340 is shown in FIG. 3. Ceramic materials include oxide ceramics, non-oxide ceramics such as nitrides, carbides, and other non-metallic materials. Specifically, the ceramic material is light translucent, and chosen from common lamp ceramic materials such as aluminum oxide, yttrium-aluminum garnet (YAG), yttrium oxide, dysprosium oxide, and other such materials. Preferably the non-conductive ceramic seal member is the same ceramic material as the arc discharge chamber. This will provide similar thermal properties, such as thermal conductivity and thermal expansion, which allows for lower thermal stresses to be generated in the electrode structure, and hence a higher reliability seal. Also, chemical corrosion from the halide dose will be the similar as the main ceramic arctube, which is generally higher for ceramic lamp materials than metal electrode materials. If the identical chemical composition ceramic is chosen, care should be taken to process the ceramic in a similar way, such that the thermal and chemical properties are similar.

In general, the dose in an operating lamp moves to the coldest spot in the lamp. Since the leg is the farthest distance from the discharge arc, the dose congregates in the leg. Hence, the volume and location of the metal halide dose has a significant impact on the performance, starting, and reliability of the ceramic induction lamp.

A preferred shape of the seal member is a long rod-shaped member because it is a simple, inexpensive shape, which is facilitated by simple ceramic fabrication processes. The seal member 340 is particularly illustrated in offset relation relative to a cavity 316 within the leg opening to illustrate one potential issue with sealing the leg, and it will also be understood that the insertion location of this seal member would be difficult to control. Centering of the seal member 340 within the cavity 316 of the leg 314 is important because a uniform seal thickness is desired, i.e., a uniform thickness of seal glass 320 between the seal member 340 and the leg 314 is desirable to provide a uniform and optimum design thickness and seal composition that will withstand attack of the chemical dose. Specifically, for the case of a circular leg geometry, the centering of the electrode member concentrically inside the leg would provide an equivalent seal thickness around the electrode member. If the seal thickness is too thin, chemical corrosion can occur more quickly due to surface effects along the interior wall and electrode surfaces. In addition, the volume of seal glass that is resisting liquid dose is lower. Precise location or insertion length of the seal member is important to optimally control the volume of the dose or fill in the sealed arc body.

Figure 4:
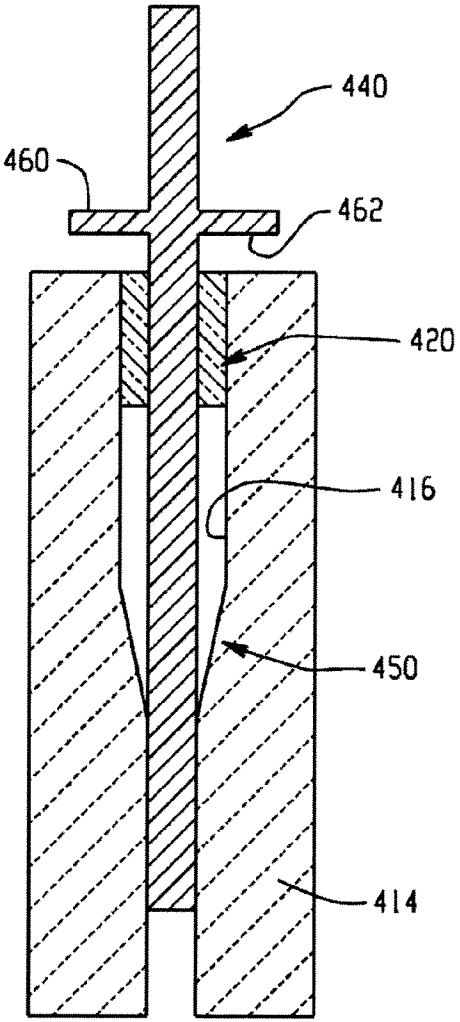
FIG. 4 is a cross-sectional view of the leg and seal member with an internal taper inside the leg and an external physical stop.

As shown in FIG. 4, one manner of addressing centering of the seal member 440 relative to the leg 414 is to employ a first tapering region 450 preferably disposed inwardly from the distal end of the leg 414 within a cavity 416. This centering function of the tapering region provides a substantially uniform or consistent thickness of seal glass 420 about the seal member 440. In addition, a stop 460 is formed on the seal member to limit or control insertion of the seal member into the leg. As will be appreciated, lower surface 462 defines a stop surface that abuts or engages against the outer, distal end of the leg and limits further insertion of the seal member or plug into the leg. Such an arrangement of the seal member and leg addresses both the centering and the precision location of the seal member 440 in the leg 414.

Figure 5:
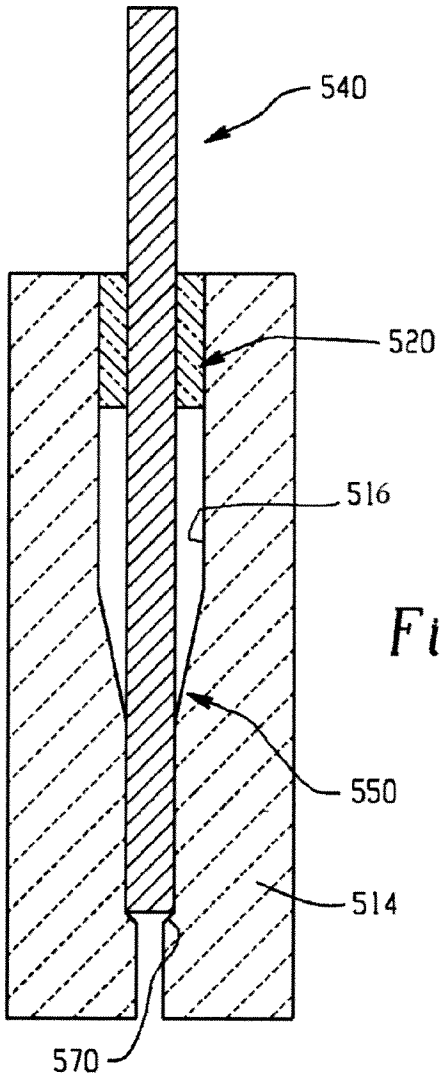
FIG. 5 is a cross-sectional view similar to FIG. 3 and employing spaced, first and second tapered regions along the inside of the leg.

In FIG. 5, another preferred embodiment eliminates manufacture and use of a physical stop that extends substantially perpendicular to the longitudinal extent of the seal member 540 as in FIG. 4 and instead employs a second, tapering region or shoulder 570 spaced axially inward from the first tapering region 550 within the cavity 516. The first tapering region still serves to center the seal member relative to the leg 514 and provides for a generally constant seal glass thickness 520 as described above. The second tapering region limits insertion of the seal member into the leg 514. Physical abutment or engagement between the inner end of the seal member and the second tapering region or shoulder 570 that has a cross-sectional dimension less than a transverse or diametrical dimension of the ceramic seal member provides for a precise, repeatable location of the seal member in the leg.

Figure 6:
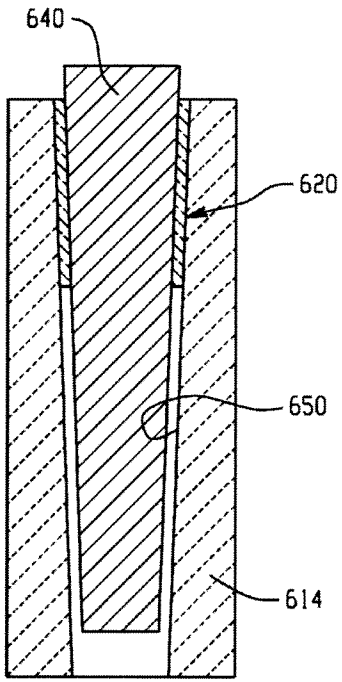
FIG. 6 is a cross-sectional view through the leg of a ceramic seal member associated with a continuous taper inside the leg.

In FIG. 6, the seal member 640 adopts a tapered configuration 620 that cooperates with an elongated tapering region 650 in the leg. The tapering region in the leg 614 ultimately is less than the minimum tapered dimension of the seal member so that further insertion of the seal member in to the leg is limited. In this manner, the thickness of seal glass 620 is closely controlled, i.e., the seal member is centered relative to the leg, and the interrelationship between the external tapered surface of the seal member and the internal tapered region of the leg provides for precise location. It is clear that many other similar configurations using a tapered seal member and a tapered region in the leg can achieve the same benefits.

Figure 8:
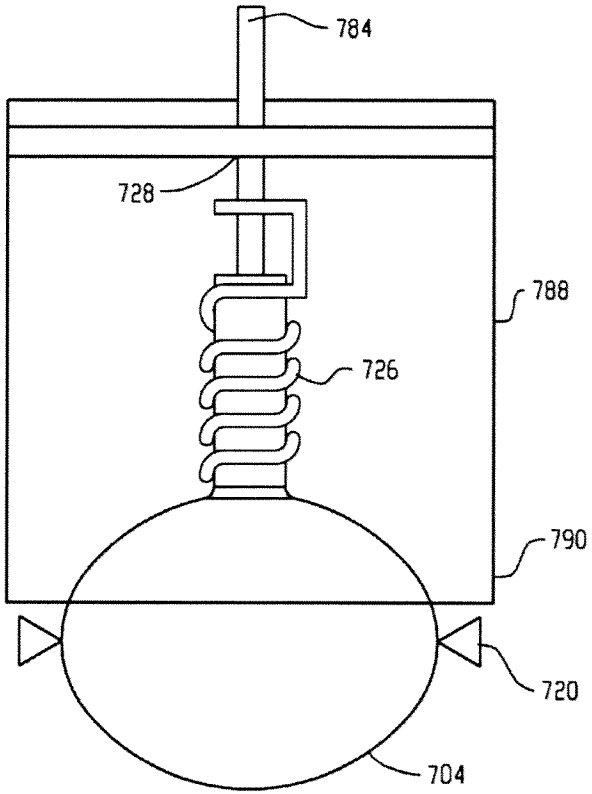
FIG. 8 is a view similar to FIG. 7 illustrating the mechanical and electrical connections with the hybrid electrode.
Figure 7:
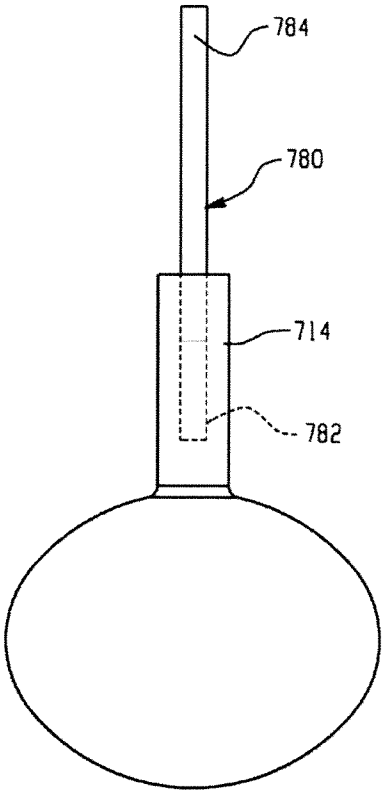
FIG. 7 is a cross-sectional view of a hybrid electrode received in the leg of an electrodeless arc body.

In the embodiment of FIGS. 7 and 8, the electrodeless lamp includes a hybrid electrode 780 partially received in the leg 714. Specifically, a first or lower portion 782 of the electrode which communicates with the arc body chamber is inserted closer to the arc body chamber than a second or upper portion 784. As shown in FIGS. 7 and 8, the first portion 782 of the seal member is electrically non-conductive (like the embodiments of FIGS. 3-6) such as a ceramic material and sealed to the leg of the arc body by a seal glass, for example. This seals or plugs the opening though the leg 714 and if desired, anyone of the structural arrangements of FIGS. 3-6 can be used to locate and center the hybrid electrode in the lamp leg. Also, as illustrated in FIG. 7, the hybrid electrode first portion 782 is preferably completely received within the confines of the leg.

The second portion 784 of the hybrid electrode is preferably electrically conductive, e.g., formed from a different material than the first portion of the hybrid electrode. Electrically non-conductive materials would include ceramics, and electrically conductive materials could include metals and cermets as described above. Electrically conductive metals and cermets provide the capacity for other processing techniques, such as welding, which are useful in the fabrication of lamp mounting assemblies. In one preferred arrangement, the second portion 784 is metal and the second portion is mechanically and electrically connected to the starting coil 726 received about the leg. Moreover, the first and second portions of the hybrid electrode are joined together, for example, via an adhesive or cermet construction, although one skilled in the art will readily recognize that the hybrid electrode portions can be secured together in a different manner than adhesive without departing from the scope and intent of the present disclosure. Thus, one end of the starting coil is both mechanically and electrically connected to the hybrid electrode and the hybrid electrode is, in turn, electrically connected to the starting circuit in the same manner as illustrated in FIG. 1. Moreover, the outer or upper end of the hybrid electrode may also serve to mechanically support a larger quartz cylinder. Particularly, the upper end of the hybrid electrode is secured or pinched at 728 within an enclosing support member or quartz cylinder 788 that abuts at an opposite or lower end 790 with the main coil 720 surrounding the spheroidal portion 704 of the arc body.

Figure 9:
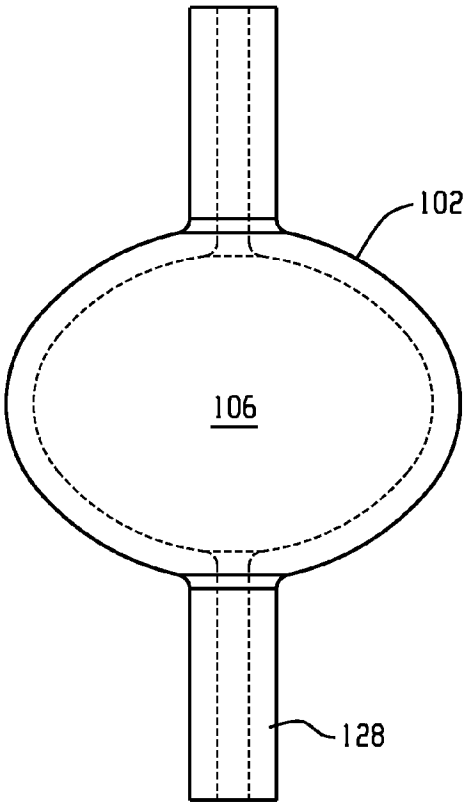
FIG. 9 is an elevational view, partly in section, of an alternate embodiment of an electrodeless or induction HID lamp.

FIG. 9 shows an alternate embodiment of a main envelope or arc body 102. In this embodiment, an additional leg 128 is shown in communication with the arctube chamber 106. This leg may be for mounting, starting, sealing, dosing, or other purposes useful in the manufacture and application of an induction or electrodeless lamp. Clearly, additional numbers of legs which require an improved seal and leg design are envisioned at various locations around the main envelope 102.

Figure 10:
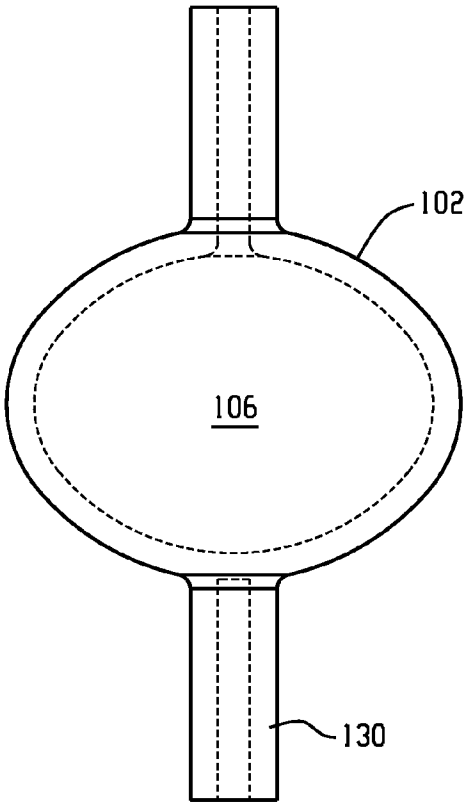
FIG. 10 is an elevational view, partly in section, of an alternate embodiment of an electrodeless or induction HID lamp.

FIG. 10 shows another alternate embodiment of a main envelope or arc body 102. In this embodiment, an additional leg 130 is shown that is not in communication with the arctube chamber 106. This leg may be for mounting, starting, or other purposes useful in the manufacture and application of an induction or electrodeless lamp, but still require the novel leg and seal design described herein. Clearly, additional numbers of legs that either communicate or do not communicate with the arctube chamber 106 at various locations around the main envelope 102, are envisioned.

Figure 11:
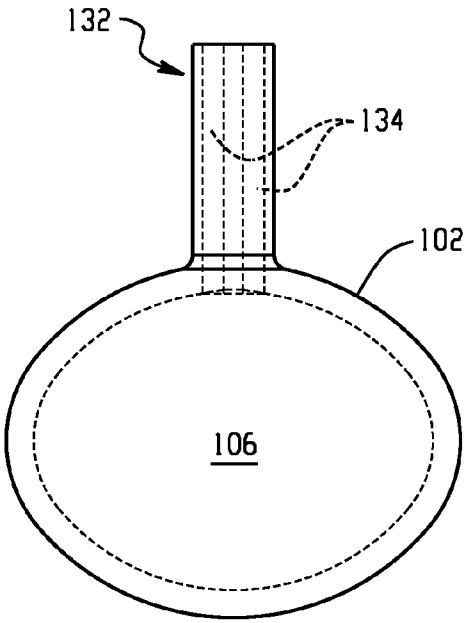
FIG. 11 is an elevational view, partly in section, of an alternate embodiment of an electrodeless or induction HID lamp.

FIG. 11 shows yet another alternate embodiment of a main envelope or arc body 102. In this embodiment, the envelope extension or leg 132 has multiple hollow cavities 134, which require sealing. In this embodiment, one cavity could be used for dosing, and the other cavity(ies) for starting, mounting, sealing, or other purposes, or combinations thereof. Having multiple hollow cavities on one side of the lamp that either communicate or do not communicate with the inner chamber 106 may be preferable to increase the amount of useful light that is emitted from the lamp.

The disclosure has been described with reference to the preferred embodiments. Obviously, modifications and alterations will occur to others upon reading and understanding the preceding detailed description. For example, the seal glass is present to hermetically seal the internal contents of the lamp relative to the outside environment. It is also conceived that a seal glass may not be required, and a monolithic seal may be made between the seal member and the leg. It is intended that the disclosure be construed as including all such modifications and alterations.

What is claimed is:

1. An electrodeless ceramic arc body comprising:

a main body having an electrodeless chamber therein;

at least one leg extending from the main body having an internal opening therethrough that communicates with the chamber;

an electrically non-conductive seal member received in the leg opening for sealing the leg, wherein the internal opening includes a first tapered portion for centering the seal member in the internal opening and a second tapered portion spaced from the first tapered portion for limiting insertion length of the seal member in the internal opening; and a seal glass received in the internal opening around a portion of the seal member.

2. The ceramic arc body of claim 1 wherein the non-conductive material is a ceramic.

3. The ceramic arc body of claim 2 wherein the non-conductive material is the same material that the ceramic arc body is composed of.

4. The ceramic arc body of claim 1 wherein the second tapered internal surface reduces to a cross-sectional dimension less than a minimum cross-sectional dimension of the seal member.

5. The ceramic arc body of claim 1 wherein the first tapered internal surface reduces in cross-sectional dimension from a first distal end of the leg toward a second end of the leg adjacent the main body to center the seal member within the leg.

6. The ceramic arc body of claim 1 wherein a surface around the leg opening is shaped to match an outer surface of the seal member.

7. The ceramic arc body of claim 1 wherein the seal glass is interposed between the seal member and the leg.

8. An induction ceramic high intensity discharge lamp comprising:

an arc body having a spheroidal portion enclosing a main discharge chamber and a leg extending from a polar region of the spheroidal portion, the leg including an opening therethrough for dosing the main discharge chamber; and a seal member dimensioned for receipt in the leg opening, an inner surface of the leg opening having a tapered portion for centering the seal member in the leg opening and a second tapered portion spaced from the tapered portion for limiting insertion length of the seal member in the leg opening.

9. The lamp of claim 8 further comprising seal glass interposed between the seal member and the leg.

10. The lamp of claim 8 wherein the seal member is at least partially non-conductive and formed from the same material as the arc body.

11. The lamp of claim 10 further comprising seal glass interposed between the seal member and the leg.

12. The lamp of claim 8 wherein the seal member is an electrically non-conductive material.

13. The lamp of claim 8 wherein the seal member is a ceramic material.

14. A method of sealing a leg opening at a first end and a second end of the leg communicating with an arc chamber of an electrodeless ceramic arc body comprising:

inserting an electrically non-conductive seal member in the first end of the leg opening;

using a first tapering region in the first end of the leg opening to center the seal member relative to the leg opening;

limiting insertion of the seal member into the leg opening at the first end wherein the limiting step includes abutting the seal member against a second tapering region spaced from the tapering region; and providing a seal glass to fill between the seal member and the leg.

* * * * *